US005787938A

United States Patent [19]

Starlinger Huemer

[11] Patent Number: 5,787,938

[45] Date of Patent: Aug. 4, 1998

[54] FABRIC DRAW-OFF DEVICE IN A CIRCULAR LOOM

[75] Inventor: Franz Starlinger Huemer, Vienna, Austria

[73] Assignee: Starlinger & Co., Gesellschaft MBH, Vienna, Austria

[21] Appl. No.: 817,529

[22] PCT Filed: Sep. 19, 1995

[86] PCT No.: PCT/AT95/00182

§ 371 Date: Apr. 17, 1997

§ 102(e) Date: Apr. 17, 1997

[87] PCT Pub. No.: WO96/12838

PCT Pub. Date: May 2, 1995

[30] Foreign Application Priority Data

Oct. 20, 1994 [CH] Switzerland ..... 3149/94

[51] Int. Cl.[6] ..... D03D 37/00; D03D 49/20

[52] U.S. Cl. ..... 139/457; 139/110

[58] Field of Search ..... 139/457, 459, 139/110

[56] References Cited

U.S. PATENT DOCUMENTS

| | | | |
|---|---|---|---|
| 4,658,862 | 4/1987 | Huemer | 139/457 |
| 4,942,908 | 7/1990 | Imamura | 139/110 |
| 5,024,253 | 6/1991 | Kawabata et al. | 139/110 |
| 5,617,905 | 4/1997 | Ziegler | 139/459 |

FOREIGN PATENT DOCUMENTS

| | | | |
|---|---|---|---|
| 0 214 668 | 3/1987 | European Pat. Off. | 139/110 |

*Primary Examiner*—Andy Falik

*Attorney, Agent, or Firm*—Hoffman & Baron, LLP

[57] ABSTRACT

A device for drawing-off a fabric in a circular loom where the circular loom has a drive motor for driving a main shaft and a weft monitoring assembly for detecting a fault in a weft. The device has a separate motor for driving the fabric draw-off rollers, a computer that controls the rotational speed of the separate motor through a speed regulating device, and a pulse generator that generates control pulses proportional to the rotational speed of the main shaft. In the event of a fault in the weft detected by the weft monitoring assembly, the computer readjusts the rotational speed of the separate motor.

6 Claims, 1 Drawing Sheet

FABRIC DRAW-OFF DEVICE IN A CIRCULAR LOOM

BACKGROUND OF THE INVENTION

The present invention relates to a fabric draw-off device in a circular loom, in which a plurality of sectional shafts are arranged in a circular way around a round reed and each carry a plurality of inner and outer harnesses for guiding a part of the two circularly distributed warp assemblages which are subjected to an opposing upwardly and downwardly alternate movement for forming the weaving or walking shed via a rotating main shaft which drives in a rotary manner the weaving shuttle in the circular reed via a plate cam and the woven hose thus formed is drawn off through the fabric draw-off device.

In such circular looms the drawing off of the fabric occurs via gear means in direct drive connection with the main shaft of the loom.

Considerably disadvantageous in such circular looms are the thin places occurring in the fabric after a weft fault caused by the exhaustion of the weft bobbin of the one or other rotating shuttle or as a result of weft breakages, for example. Although the usual weft monitoring means on the reed of the machine are usually capable, after an ascertained weft fault, of transmitting immediately a stop signal to the main shaft of the circular loom, on the one hand, and to the motor of the machine driving the fabric draw-off apparatus, on the other hand. The motor, however, will not come to a standstill abruptly, however, but will continue to rotate under the influence of the large forces due to inert-:a which have an effect on the main shaft. In this way, however, there is further drawing-off of the fabric into which fewer wefts per length of warp are woven into during the after-runnings of the shuttles, because at least one weft is missing. The shuttles will usually make two to three rotations until the complete standstill of the machine after a stop of the machine.

OBJECT AND SUMMARY OF THE INVENTION

It is the object of the present invention to arrange the fabric draw-off device of such a circular loom in such a way that the previously unavoidable thin places in the fabric as a result of the after-running of the stopped machine are prevented.

This is achieved at first in accordance with the invention by a separate motor driving via gear means at least the draw-off rollers and, optionally, the fabric bales. The speed of rotation of the motor is controllable by a computer via a speed-regulating device which is connected to the main drive of the circular loom via a pulse generator or the like for producing control pulses proportional to the speed of rotation of the circular loom or the main shaft, respectively.

This allows at first a control for accelerating or decelerating the fabric draw-off which is immediately linear to the speed of rotation of the circular loom, so that particularly in the frame zone or also during the run-up of the loom undesirable changes to the predetermined weft count are prevented.

Furthermore, the computer can be programmed through its keyboard so that the weft count can be varied in the finest of stages by changing the sequence of the control pulses in order to additionally change the speed of rotation of the motor of the fabric draw-off device independent of the speed of rotation of the circular loom.

In order to furthermore exclude entirely any weaving faults in case of a weft breakage, the computer additionally is provided with a signal connection with a weft monitoring means, so that it will cause immediately after a weft fault a readjustment of the speed of rotation of the motor of the fabric draw-off device in a predetermined manner.

BRIEF DESCRIPTION OF THE DRAWINGS

An exemplified embodiment of the subject matter of the invention is shown below by reference to the enclosed drawing which shows in a side view and in a schematic view a circular loom with the means of the fabric draw-off device in accordance with the invention in a detailed way.

DETAILED DESCRIPTION OF THE PREFERRED EMBODIMENTS

Figure 1:
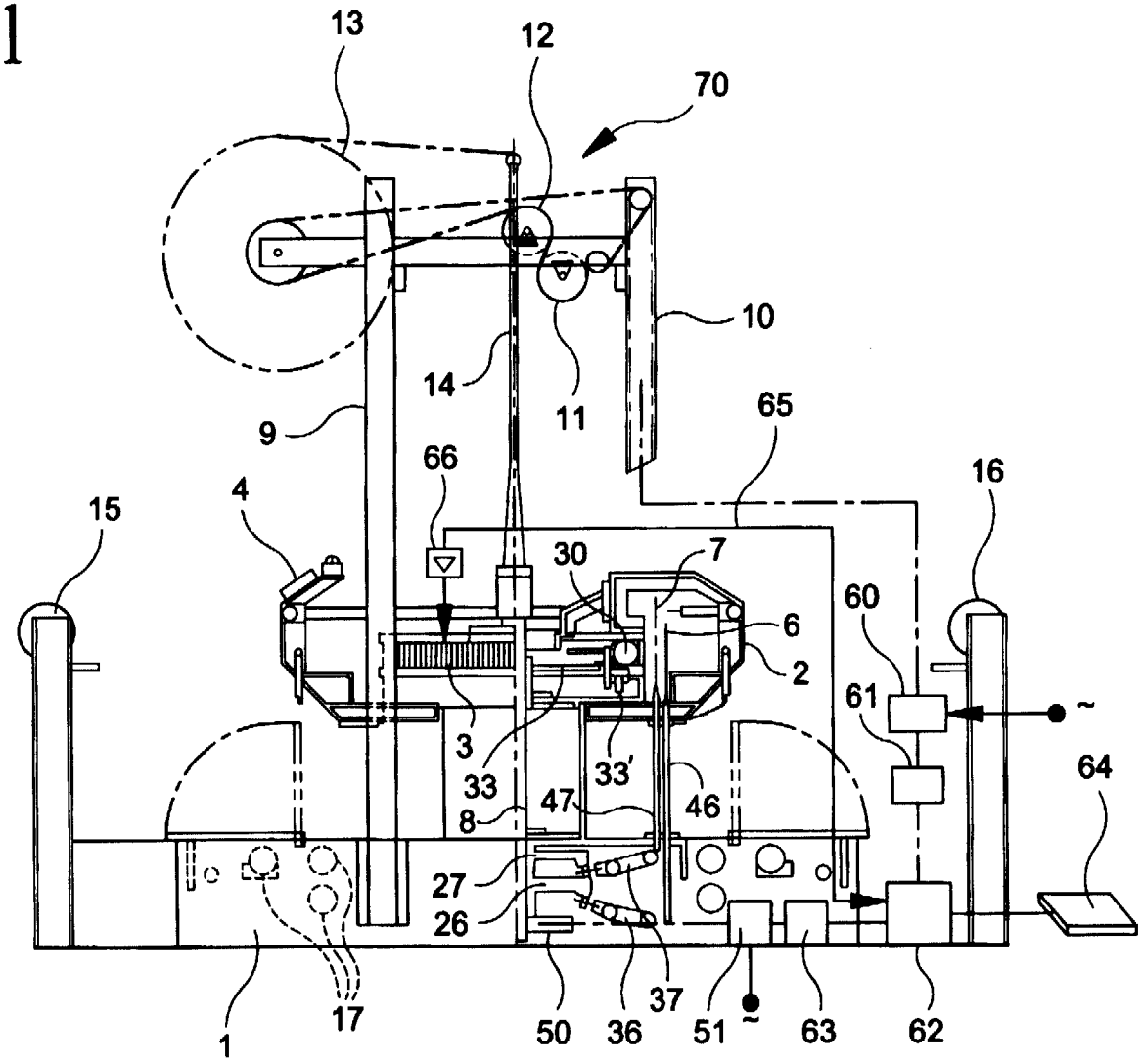

The shown multiphase loom rests in the usual manner on the basic frame 1 of the machine, on which a circular frame carrier 2 rests, which carries the reed 3, the "on" and "off" button 4 for the machine, the frame parts 5 for the ring holders and, among other things, the sectional shafts 6 and 7. These sectional shafts 6 and 7 are arranged in a circular way in two rows around the main shaft 8 of the machine, whereby they form the outer 6 and inner sectional shafts 7.

The drawing further shows in the loom the drawing-in roller 15 for the ends or warp ties (not shown in closer detail) on the left and the drawing-in rollers 16 for the ends on the right and, in addition, the deflecting rollers 17 for said warp ties. Said ends or warp ties are divided into two circularly arranged warp assemblages and are drawn off in the known manner by groups of warp bobbins (not shown in closer detail). For forming the weaving shed one of these assemblages is then lifted by the sectional shafts, whereas the other is guided from the level of the weaving plane downwardly through the so-called shed changing movements, so that a warp thread upper shed and a warp thread lower shed arises. At least one, but usually several shuttles 30 with a weft bobbin on a horizontal circular path are guided into this so-called weaving or walking shed.

The drive of the shuttles 30 is usually made through a, plate cam 33 which rests rotationally rigidly on the main shaft 8 of the machine and which acts on the shuttles in a sliding way by means of sliding means 33'. The main shaft 8 is connected for this purpose to a drive motor 51 via gear means 50.

Moreover, the main shaft 8 carries two further plate cams 26 and 27 which are provided with a plurality of In pivoting levers 36 and 37 which are arranged in a radially distributed manner around said plate cams and which are in operative connection with so-called shaft rods 46 and 47, which transmit in the known manner the changing movements of the shed to the sectional shafts 6 and 7.

As a result of the circular movement of the shuttles the weft wound off from the weft bobbin is delivered to the fabric edge of the produced woven hose, so that said weft can be weaved into the fabric. The woven hose can then be drawn off upwardly and can be laid into a flat circular fabric.

For this purpose carrier 9 for the fabric draw-off apparatus 70 rests on basic frame 1. The draw-off apparatus comprises, among other things, gear means 10 for drawing off the fabric, fabric draw-off rollers 11 and 12 and the fabric bale 13. A fabric expander 14 is also effective in the draw-off zone.

To this point the arrangement of the circular loom as outlined above coincides with the known state of the art, so that any fur-her explanation of the machine can be omitted.

The problem to be dealt with in such a circular loom consists of the separation of the main shaft 8 or the main motor 51 from the drive of the fabric draw-off apparatus 70 whose draw-off rollers were previously tensionally connected with the main shaft 8 or the main motor 51 via a gear with change gears and chain connections.

This problem is solved in accordance with the invention by a separate motor 60 which drives via gear means 10 at least the draw-off rollers 11, 12 and, optionally, the fabric bale 13. The speed of rotation of said motor is controllable by a computer 62 via a speed-regulating device 61, which computer is connected with the main drive 51,8 of the circular loom via a pulse generator 63 or the like for producing control pulses proportional to the speed of rotation of the circular loom or the main shaft 8.

This allows at first a control for accelerating or decelerating the fabric draw-off which is linear with respect to the speed of rotation of the circular loom, so that particularly in the turning-off range or during run-up of the loom undesirable changes in the predetermined weft count are avoided.

Furthermore, computer 62 can be programmed via its keyboard 64 in such a way that the weft count can be varied in the finest of stages by changing the sequence of the control pulses so as to additionally change the speed of the motor 60 of the fabric draw-off device independent of the speed of rotation of the circular loom.

This effect can be used additionally in order to periodically carry out weft condensations in the fabric, which form horizontal stripes, in a simple way and at predetermined distances, at which places a separation of the fabric web is carried out thereafter, whereby the weft condensations form reinforcements for sack edges and sack floors during the production of sacks, for example.

In order to exclude weaving faults in case of a weft breakage, the computer 62 is further provided with a signal connection 65 with weft monitoring means 66 (not explained herein in closer detail) in order-to initiate Immediately after a weft fault a readjustment of the speed of rotation of the motor 60 of the fabric draw-off device, which ensures an even weft count, even when a weft suddenly falls out owing to a weft breakage.

The computer can, for example, reduce the speed of rotation at the fabric draw-off by half in case of a thread breakage in a loom with four simultaneously rotating shuttles, by a third with six shuttles, by a one-fourth with eight shuttles and by one-fifth with ten shuttles. This allows by delaying the feed of the fabric draw-off that the remaining intact wefts are sufficient to maintain the predetermined weft count.

In this respect it is advantageous that the arrangement in accordance with the invention can be connected directly to a data processing unit via respective interfaces on the computer in order to monitor the entire processing situation of the loom and, in addition, to simultaneously control a plurality of such circular looms.

It is understood that: modifications can be made to the device described above without departing from the inventive step, in particular the shed-forming means in the loom may be of any kind.

What is claimed is:

1. A circular loom having a device for drawing-off a fabric, said circular loom comprising:

a circular reed;

a plurality of inner sectional shafts arranged in a circular way around said circular reed;

a plurality of inner harnesses which are carried by said plurality of inner sectional shafts;

a plurality of outer sectional shafts arranged in a circular way around said circular reed;

a plurality of outer harnesses which are carried by said plurality of outer sectional shafts;

a main shaft;

a drive motor for driving said main shaft at a speed of rotation;

said plurality of inner and outer harnesses guiding a part of two circularly distributed warp assemblages which are subjected to an opposing upwardly and downwardly alternate movement via said main shaft forming a weaving shed a plate cam;

a weaving shuttle being driven in a rotating way in said circular reed by said main shaft via said plate cam forming a fabric;

a weft monitoring means; and a device for drawing-off the fabric, said drawing-off device including:

a computer having a signal connection with said weft monitoring means;

a pulse generator being linked between said computer and said drive motor for producing control pulses proportional to said speed of rotation of said main shaft;

a separate motor having a rotational speed;

a speed regulating device being linked between said computer and said separate motor for controlling said rotational speed of said separate motor;

a gear means; and a plurality of fabric draw-off rollers for drawing off the fabric, said plurality of fabric draw-off rollers being driven by said separate motor via said gear means;

whereby said computer readjusts said rotational speed of said separate motor when there is a fault in the weft detected by said weft monitoring means.

2. A circular loom as defined in claim 1, whereby said rotational speed of said separate motor is continuously adjustable by said computer and independent from said speed of rotation of said main shaft.

3. A circular loom as defined in claim 1, further comprising a fabric bale being driven by said separate motor via said gear means.

4. A device for drawing-off a fabric in a circular loom, the fabric being drawn off from the circular loom having a drive motor for driving a main shaft at a speed of rotation and a weft monitoring means for detecting a fault in a weft, said drawing-off device comprising:

a computer having a signal connection with the weft monitoring means;

a pulse generator being linked between said computer and the circular loom for producing control pulses proportional to the speed of rotation of the main shaft;

a separate motor having a rotational speed;

a speed regulating device being linked between said computer and said separate motor for controlling said rotational speed of said separate motor;

a gear means; and a plurality of fabric draw-off rollers for drawing off the fabric, said plurality of fabric draw-off rollers being driven by said separate motor via said gear means;

whereby said computer readjusts said rotational speed of said separate motor when there is a fault in the weft detected by the weft monitoring means.

5. A device for drawing-off a fabric in a circular loom as defined in claim 4, whereby said rotational speed of said separate motor is continuously adjustable by said computer and independent from the speed of rotation of the main shaft.

6. A device for drawing-off a fabric in a circular loom as defined in claim 4, further comprising a fabric bale being driven by said separate motor via said gear means.

* * * * *

UNITED STATES PATENT AND TRADEMARK OFFICE

CERTIFICATE OF CORRECTION

PATENT NO. : 5,787,938
DATED : August 4, 1998
INVENTOR(S) : Franz Starlinger Huemer It is certified that error appears in the above-identified patent and that said Letters Patent is hereby corrected as shown below:

TITLE PAGE:

| | |
|---|---|
| In Heading [75] for Inventor, | now reads "**Franz Starlinger Huemer,** Vienna, Austria" should read, --**Franz Starlinger Huemer**, Wien, Austria--. |
| In Heading [73] for Assignee, | now reads "**Starlinger & Co., Gesellschaft MBH**, Vienna, Austria" should read, --**Starlinger & Co., Gesellschaft MBH**, Wien, Austria--. |
| In Heading [87] for PCT Publication, | now reads "PCT Pub. Date: **May 2, 1995**" should read, --PCT Pub. Date: **May 2, 1996**--. |

UNITED STATES PATENT AND TRADEMARK OFFICE

CERTIFICATE OF CORRECTION

PATENT NO. : 5,787,938

DATED : August 4, 1998

INVENTOR(S) : Franz Starlinger Huemer

It is certified that error appears in the above-identified patent and that said Letters Patent is hereby corrected as shown below:

Column 1, Line 30, the patent now reads -- due to inert-:a--; this should read --due to inertia--.

Column 2, Line 42, the patent now reads --In pivoting levers; this should read --pivoting levers--.

Column 2, Line 61, the patent now reads --any fur-her--; this should read --any further--.

Signed and Sealed this

Twenty-seventh Day of October, 1998

Bruce Lehman

*Attest:*

BRUCE LEHMAN

*Attesting Officer*

*Commissioner of Patents and Trademarks*